US006916348B2

(12) United States Patent
Fennen et al.

(10) Patent No.: US 6,916,348 B2
(45) Date of Patent: Jul. 12, 2005

(54) DYED LEATHER AND METHOD FOR DYEING TANNED LEATHER

(75) Inventors: Jens Fennen, Wyhlen (DE); Campbell Thomas Page, Efringen-Kirchen (DE); Jon Louis McHugh, Greensboro, NC (US)

(73) Assignee: TFL Ledertechnik GmbH, Weil am Rhein (DE)

( * ) Notice: Subject to any disclaimer, the term of this patent is extended or adjusted under 35 U.S.C. 154(b) by 27 days.

(21) Appl. No.: 10/363,821

(22) PCT Filed: Aug. 27, 2001

(86) PCT No.: PCT/EP01/09840

§ 371 (c)(1),
(2), (4) Date: Mar. 7, 2003

(87) PCT Pub. No.: WO02/20897

PCT Pub. Date: Mar. 14, 2002

(65) Prior Publication Data

US 2004/0025260 A1 Feb. 12, 2004

(30) Foreign Application Priority Data

Sep. 8, 2000 (DE) ..... 100 44 642

(51) Int. Cl.[7] ..... D06P 3/32

(52) U.S. Cl. ..... 8/437; 8/436; 8/94.22; 8/652; 8/657; 8/661

(58) Field of Search ..... 8/436, 437, 608, 8/94.22, 652, 657, 667

(56) References Cited

U.S. PATENT DOCUMENTS 4,398,911 A * 8/1983 May et al. ..... 8/94.16
4,557,731 A 12/1985 Sasakura et al.
6,043,349 A * 3/2000 Berenguer ..... 534/678

FOREIGN PATENT DOCUMENTS

| | | |
|---|---|---|
| DE | 30 01 301 | 7/1981 |
| DE | 196 30 453 | 1/1998 |
| GB | 906 526 | 9/1962 |

OTHER PUBLICATIONS

Jander–Blasus, "Lehrbuch der analytischen und praäparativen anorganischen chemie", S. Hirzel Verlag Stuttgart, XP002187079, pp. 239–240, 1973.

* cited by examiner

*Primary Examiner*—Margaret Einsmann
(74) *Attorney, Agent, or Firm*—Wenderoth, Lind & Ponack, L.L.P.

(57) ABSTRACT

Tanned leather is (a) pretreated in an aqueous and alkaline medium either with ammonia, primary amines or a mixture of ammonia and primary amines and then with a polyfunctional organic compound containing at least one aldehyde group as a functional group, or (b) in an aqueous and acidic medium with a polyfunctional organic compound and then ammonia, primary amines or a mixture of ammonia and primary amines, and (c) then dyed in an aqueous and alkaline medium with a water-soluble dye containing at least one functional group which is capable of reacting with one of the functional groups of the organic compound, forming a covalent bond. A tanned and dyed leather is obtainable with a high color intensity, outstanding wet fastness and excellent grain tightness, wherein the dye is permanently and covalently bonded to the leather via a bridging group, preferably in the region of the surface, and the bridging group is essentially bonded to the leather via —N═CH— groups.

43 Claims, No Drawings

DYED LEATHER AND METHOD FOR DYEING TANNED LEATHER

The present invention relates to a process for dyeing tanned leather, in which the first step in the wet end process comprises either (a1) first allowing ammonia, primary amines or a mixture of ammonia and primary amines in an aqueous and alkaline medium to act on the tanned leather and (a2) then treating this leather in an aqueous and alkaline medium in the presence of ammonia, primary amines or a mixture of ammonia and primary amines with a polyfunctional organic compound comprising at least one aldehyde group as a functional group, or (b1) first allowing a part or all of a polyfunctional organic compound comprising at least one aldehyde group as a functional group to act on the tanned leather in an aqueous and acidic medium and (b2) then allowing ammonia, primary amines or a mixture of ammonia and primary amines in an aqueous and alkaline medium and then, if necessary, the remainder of the polyfunctional organic compound to act on the tanned leather, then (c) allowing a dye comprising at least one functional group to act on the treated leather in an aqueous and alkaline medium, wherein this functional group is capable of reacting with one of the functional groups of the organic compound forming a covalent bond and then, after acidification if necessary, (d) draining the dye liquor and washing the dyed leather with water. The present invention also relates to tanned and dyed leather in which the dye is permanently and covalently bonded to the leather via a bridging group, preferably in the region of the surface, and the bridging group is essentially bonded via —N═CH groups to the leather; and auxiliary agents used in the dyeing process. The leather referred to in the invention may be processed to finished products in the normal manner by retanning, fatliquoring, finishing and other customary practices.

The dyeing of tanned leather to achieve high colour intensities and high colour fastness, in particular wet fastness, is difficult and has not to date been satisfactorily solved. Since the properties of leather tanned with metal salts undergo negative changes at pH values above 6–7, working in an acidic aqueous medium has become the accepted practice in retanning, fatliquoring and dyeing. The customary process steps for leather tanned with metal salts comprise first the washing and neutralization of leather tanned with metal salts which shows a pH value in water of about 4.5 to 6.5. Then the leather is treated with retanning agents in an acidic aqueous medium in order to confer certain properties such as tensile strength, fullness, hardness or softness. Leather pretreated in this way is then treated with anionic dyes in a fresh bath, preferably above the isoelectric point and often in the presence of penetration agents, in order to achieve dye penetration of the leather and a good colour intensity. The leather is then treated with a fat liquor which imparts the desired softness, flexibility and strength to the leather. Now it is important to fix the fat liquor and dye, which is done in the same bath by lowering the pH value, for example by adding formic acid. With leathers dyed in this way, the colour intensity and fastness to bleeding and rubbing generally have to be further improved. To this end, the leather is re-dyed in a new dye liquor. Through the addition of cationic agents, more dye can be fixed at the surface of the leather. To improve the wet fastness further, the retanned leather may be treated with cationic complexing agents, which form a complex with the dye and thus reduce its solubility in contact with water. The attainable wet fastness and abrasion resistance, however, are not yet sufficient for intensive colour nuances. Furthermore, leather products manufactured in this way tend to discolour. To prevent this bleaching or discoloration, the dyed leather is often given a thin protective polymer layer. The dyeing process in an aqueous and acidic medium is complex, as a result of the various process steps and chemicals used, and it generates a large volume of wastewater, which makes disposal costly. The wet treatment of leather carried out in an acidic, aqueous medium, including retanning, dyeing, fatliquoring and aftertreatment, is described for example in : "Bibliothek des Leders", volume 3 (*Gerbmittel, Gerbung und Nachgerbung*) [1985], volume 4 (*Entfetten, Fetten und Hydrophobefien beider Lederhersteilung*) [1987] & volume 5 (*Das Färben von Leder*) [1987] Umschau Verlag; "Leather Technicians Handbook", 1983, by J. H. Sharphouse, published by the Leather Producers Association; and "Fundamentals of Leather Manufacturing", 1993, by E. Heidenmann, published by Eduard Roether KG.

To eliminate at least some of the disadvantages of dyeing in an acidic medium and of inadequate wet fastness of the dyed leather, it has already been proposed that reactive dyes be covalently bonded to the leather. In the JSLTC (1962), pages 162–165, T. C. Mullen describes reactive dyes for leather to whose backbone chain a cyanuric chloride is covalently bonded as a reactive functional group. In the JSLTC (1973), pages 486–494, M. L. Fein et al. describe reactive dyes for leather to whose backbone chain a vinylsulfonic group is covalently bonded as a reactive functional group. The aim is that in the dyeing process these reactive dyes are covalently bonded to leather via the reactive functional groups. This dyeing technique requires the addition of electrolytes (salts), and the process is carried out at a pH value of 7–8 or more, at which leather tanned with metal salts shows insufficient stability. This dyeing technique only allows the use of leathers which have been tanned with organic tanning agents (for example glutaraldehyde) or simultaneously with metal salts and organic tanning agents (for example, glutaraldehyde). Reactive dyes have also been used for leather tanned purely with metals. With these reactive dyes, however, no deep and wet-fast colour tones can be achieved, because their reactivity to leather is insufficient, and an increase in reactivity through a rise in temperature is not possible because of the thermal stability of the leather. Thus, only light to medium colour tones can be achieved. In addition, hydrolysates are formed from the reactive dye during the dyeing process have to be removed after dyeing together with non-reacted dye. As a rule, this is not possible without harming the leather. As a result of these disadvantages, reactive dyes have not managed to gain acceptance.

The disadvantages described above were recently referred to in The Leather Manufacturer (1999), pages 18 to 23. In this publication, it is furthermore proposed that dyes with free amino groups be covalently bonded to the collagen fibres of the leather by means of cross-linking agents, with the aim of forming carbonamide bonds. It is expressly pointed out that, under the given reaction conditions, nucleophilic groups other than amino groups are unsuitable, because the temperature and pH adjustments necessary are too high, thus excluding the use of leather as a substrate owing to its lack of stability under these conditions. Retanning, dyeing and fatliquoring are therefore carried out as usual under acidic conditions. With this dyeing technique, the leather is first treated with a dye so that this can penetrate the leather. Suitable dyes are only those which contain more than one amino group. Then aftertreatment is carried out using cross-linking agents such as tetrakishydroxymethylphosphonium chloride, polyaziridine or glutaraldehyde. Under these conditions, the formation of —NH—C— bonds can occur at most on a scale that is not measurable, because the amino groups of the dye react for example with the aldehyde groups of the glutaraldehyde and form condensates consisting of oligomers to low-molecular polymers, which become deposited on the surface of the collagen fibrils of the leather. The colour fastness is hereby improved by means of the increased insolubility of the condensate. The wet fastness and abrasion resistance which can be achieved, however, are not yet considered sufficient, because it is also recommended that the dyed leather be coated with polymers in order to improve the colour fastness further.

In Das Leder 21(8), pages 148–151 (1980), a dyeing of anionic tanned or retanned leather is described using anionic dyes wherein a homogeneous cationic activation of the leather surface is first achieved by means of a pre-reaction with glutaraldehyde and ammonium sulfate in the presence of the leather in an acidic medium before the dyeing process is carried out. This pre-treatment is exclusively for the purpose to carry out a dyeing according to the state of art in the acidic conditions. An increase in the dye intensity is achieved but considerably less than that obtained when the retanning with anionic tanning agents is first made after the dyeing in alkaline conditions. In DE-A-3 001 301 is principally the same process written, but additionally mentioned, that the pre-treatment with aldehyde or dialdehyde and ammonium salt can be carried out up to a pH value of 8. However, according to example 4, at a pH value of 7.7, it is especially mentioned that at the upper end of this pH range the quality of the leather is already reduced.

It has now surprisingly been found that deeper colour tones and extremely high colour fastness, in particular an outstanding wet fastness, can be achieved when tanned leather is treated either after impregnation with a polyfunctional organic compound comprising at least one aldehyde group in the acidic range or before impregnation first with ammonia or a primary amine in the alkaline range, before adding a polyfunctional organic compound with at least one aldehyde group and allowing this to react, and only then reacting it with a dye comprising functional groups which are able to react with functional groups of the organic compound. In this way, it is possible to bond the selected dyes covalently to the leather via a bidging group formed from the organic compound. It was further surprisingly found that leather tanned with metal salts, such as chromium salts can also be dyed under alkaline conditions without any substantial negative changes in its properties. In the case of leather tanned with metal salts, the grain is normally very loose when treated in the alkaline medium, becoming detached from the underlying collagen fibres (drawn grain) and causing the leather to form wrinkles. By contrast, leather dyed according to the invention in alkaline medium shows most surprisingly an extremely high degree of grain tightness. For example, a very tightly grained shoe upper leather can be manufactured, even though the dye liquors show a pH value of more than 5.5. Furthermore, this leather can be treated with large quantities of fat liquors, especially waterproofing agents, without any reduction in the high degree of grain tightness. By this means, it is possible to obtain a soft dyed leather with improved water resistance which is especially suitable for the manufacture of shoes, but also of leather clothing and furniture. Furthermore, the process according to the invention can surprisingly be controlled in such a way that either hard or soft leather can be produced using the same dyeing process.

Leather dyed according to the invention is characterized by improved and outstanding grain tightness, extremely deep colour intensity and outstanding colour fastness. In the broader sense, the achievement of improved waterproofing of the dyed leather is also to be mentioned.

The process according to the invention offers substantial benefits in terms of process engineering, as well as economic and ecological advantages. During dyeing, the dye can be almost fully exhausted from the liquor, rendering it virtually free from the dye. As a result of the high degree of wet fastness, the next steps in the treatment of the leather, for example with retanning agents, softeners and/or fat liquors, can be performed without any substantial losses of dye. Owing to the depth of colour which can be achieved, only a small amount of dye is consumed and no additional fixation has to be carried out. The use of dyeing assistants, such as penetration agents and electrolyte salts can be avoided. In many cases, the process according to the invention also leads to a marked simplification and shortening of the production process, because process steps such as additional surface dyeing can be dispensed with. This reduces the chemical burden on the dye liquor and hence simplifies disposal. Particular attention is to be drawn to the improvement of occupational hygiene, since there is no concern that parts of the body, clothing or machinery may become contaminated with the dye on contact with the dyed leather.

An object of the invention is a process for the dyeing of tanned leather which comprises either (a1) first allowing ammonia, primary amines or a mixture of ammonia and primary amines in an aqueous and alkaline medium to act on the tanned leather and (a2) then treating this leather in an aqueous and alkaline medium in the presence of ammonia, primary amines or a mixture of ammonia and primary amines with a polyfunctional organic compound comprising at least one aldehyde group as a functional group, or (b1) first allowing part or all of a polyfunctional organic compound comprising at least one aldehyde group as a functional group to act on the tanned leather in an aqueous and acidic medium and (b2) then allowing ammonia, primary amines or a mixture of ammonia and primary amines in an aqueous and alkaline medium and then, if necessary, the remainder of the polyfunctional organic compound to act on the tanned leather, then (c) allowing a water-soluble dye comprising at least one functional group to act on the treated leather in an aqueous and alkaline medium, wherein this functional group is capable of reacting with one of the functional groups of the organic compound forming a covalent bond and then (d) draining the dye liquor and washing the dyed leather, with the proviso that the pH value in the process step c) is over 8 when using an anionic tanned or retanned leather, if an anionic dye is used.

A further object of the invention is a tanned and dyed leather obtainable or manufactured using a process according to the invention.

For the process of the invention, it is unimportant how the leather was tanned. It may have been tanned using metal salts, such as chromium salts, or with synthetic or natural organic tanning agents, such as dialdehydes or vegetable extracts. The processes used for tanning are state-of-the-art processes and are not described herein.

As a result of the reachable high wet fastness from the dyeing of tanned leather according to this invention it is an advantage that the retanning, if necessary, is made after the new dyeing process, because it is surprisingly found that the known bleaching effect of the retanning agents can be substantially avoided in this way.

Process Step a1)

In process step a1) the pH of the aqueous; alkaline medium is preferably 7 to 10, and especially preferably 7.5 to 9. The process is expediently carried out at elevated temperatures, for example 20 to 80° C., preferably 30 to 60° C. The ammonia or primary amines may act on the leather for a period of up to 1 hour for example. Generally, however, periods of about 5 to 30 minutes are sufficient. The quantity of ammonia or primary amines is designed such that the alkaline range or the preferred pH ranges are adhered to. The quantity of ammonia or primary amines may amount for example to 0.1 to 20, preferably 0.5 to 15 and especially preferably 0.5 to 10 parts by weight, in relation to 100 parts by weight of tanned leather (shaved weight). The volume of the added aqueous solution of ammonia or primary amines is dependent on the concentration of ammonia or primary amines.

The aqueous solution of ammonia or primary amines may be prepared in a manner known per se by direct introduction of gaseous ammonia into water or addition of primary amines to water, or in situ by hydrolysis of corresponding ammonium salts with bases such as alkali metal or alkaline earth metal hydroxides or alkaline earth metal oxides such as MgO, CaO, SrO or BaO. Suitable ammonium salts may be derived from inorganic or organic acids, such as hydrogen halides, sulfuric acid, phosphoric acid, carboxylic acids (formic acid, acetic acid, benzoic acid, phthalic acid, maleic acid, fumaric acid, malonic acid and succinic acid). The ammonia may also be released in situ from organic compounds such as hexamethylene tetramine, or acid amides, including urea.

Suitable primary amines are water-soluble aromatic and preferably aliphatic amines which contain 1 to 12, preferably 1 to 8, and especially preferably 1 to 4 C atoms, and which are unsubstituted or substituted with OH or $C_1$–$C_4$alkoxy. A suitable aromatic amine for example is aniline. Suitable aliphatic amines are $C_1$–$C_6$- and preferably $C_1$–$C_4$alkylamines, $C_4$–$C_8$- and preferably $C_5$–$C_6$cycloalkylamines, and $C_5$–$C_6$cycloalkyl-$C_1$–$C_4$alkylamines, which are unsubstituted or substituted with OH or $C_1$–$C_4$alkoxy. Examples of such amines are methyl, ethyl, n- and i-propyl, n-, i- and t-butyl, cyclopentyl, cyclohexyl, methoxyethyl, ethoxyethyl, 2-hydroxyethyl, 2- and 3-hydroxypropyl and 2-, 3- and 4-hydroxybutylamine.

For the in situ preparation, it has proved particularly expedient in terms of application techniques to use ammonium salts of water-soluble polymeric acids, for example polymaleic acid, polyacrylic acid, polymethacrylic acid, polysulfonic acids, polyphosphonic acids or mixed polymers of maleic acid, acrylic acid, methacrylic acid and/or olefinic unsaturated sulfonic acids. These polymeric acids may be mixed with basic compounds which release ammonia or a primary amine in aqueous solution. It is further advantageous to use salts, especially alkaline metal or alkaline earth metal salts of polymeric acids together with ammonium salts and a basic compound, which release ammonia or a primary amine in aqueous solution. It can also be expedient to mix ammonium salts of ammonia or primary amines and inorganic or organic acids, for example sulfates, hydrogen sulfates, halogenides, phosphates and hydrogen phosphates, sulfonates, phosphonates, carbonates or hydrogen carbonates, formates, acetates, propionates or benzoates, with solid and essentially anhydrous alkali metal or alkaline earth metal oxides or hydroxides in order to produce ammonia or a primary amine in situ after addition to the liquor.

A further object of the invention is a composition which in aqueous solution releases ammonia or a primary amine, comprising either a) an ammonium salt of a water-soluble polymeric acid and at least an equivalent quantity, calculated with reference to the acid value of the polymeric acid, of a basic compound, or b) a salt of a water-soluble polymeric acid and at least an equivalent quantity of a water-soluble ammonium salt of ammonia or primary amines and an essentially anhydrous inorganic and basic compound, or c) at least one ammonium salt of ammonia or primary amines with inorganic or organic acids and an equivalent quantity of a solid and essentially anhydrous inorganic and basic compound.

Preferred water-soluble ammonium salts are those of ammonia and primary amines with inorganic or organic acids, such as hydrogen halides (HCl, HBr and HI), sulfuric acid, phosphorous acid, phosphoric acid, formic acid and acetic acid. Preferred basic compounds are alkaline earth metals and especially alkali metal hydroxides or oxides, or alkali metal carbonates, for example NaOH, KOH, $Ca(OH)_2$, $Mg(OH)_2$, $Na_2O$, $K_2O$, MgO and CaO, potassium and sodium carbonate or hydrogencarbonate, as well as borax and basic phosphate salts. For the purpose of standardization, about 10 percent by weight of sodium sulfate may be added. The compounds according to the invention have a long shelf life and are easy to handle for the dyer. They can be prepared by mixing the solid components in dry mixers, as far as possible under exclusion of moisture. For rapid mixing and dissolution in the liquor it is expedient to ensure that the components are formed as powders.

The compositions according to the invention may also be formed as kits in separate containers in appropriate amounts stipulated for the process according to the invention, wherein the individual components may also be present as aqueous solutions, for example as concentrates.

Process Step a2)

At the end of process step a1), not all the ammonia or primary amine of the reaction mixture has been used up, and it is not necessary to added further ammonia or primary amine if the full amount was added in process step a1). To the reaction mixture, a polyfunctional organic compound is added which comprises at least one aldehyde group as a functional group. These organic compounds are known, and in some cases commercially available, or can be prepared using analogous known processes. The quantity of organic compound may amount for example to 0.1 to 20, preferably 1 to 15 and especially preferably 1 to 10 parts by weight, in relation to 100 parts by weight of tanned leather (shaved weight). In process step a9) the pH of the aqueous, alkaline medium is preferably 7 to 10, and especially preferably 7 to 9. The process is expediently carried out at elevated temperatures, for example 20 to 80° C., preferably 30 to 60° C. The reaction with the leather and ammonia may last for a period of, for example, up to 2 hours. Generally, however, periods of about 10 minutes to one hour are sufficient.

The polyfunctional organic compound comprises one aldehyde group and further, for example 1 to 4, preferably 1 to 3 and especially preferably 1 or 2 functional groups for covalent bonding of the dye, which is bonded to the aldehyde group either directly or via an organic bridging group. The bridging group may contain 1 to 30, preferably 1 to 20 and especially preferably 1 to 12 C atoms, where carbon bonds may be broken by O, S, NR, C(O)O or C(O)NR, wherein R is hydrogen or $C_1$–$C_4$alkyl. Suitable functional groups for the formation of covalent bonds are for example —CHO, —OH, —SH, and —NHR, wherein R is hydrogen or $C_1$–$C_4$alkyl, isocyanate, masked isocyanate, carboxyl, carboxylate, carbamide, sulfoxyl, sulfoxylate, and sulfonamide. An especially preferred functional group is —CHO.

A preferred group of polyfunctional organic compounds is that of formula I, $$OHC—B—(F)_x \quad (I),$$

wherein

B is a direct bond or a bivalent or trivalent bridging group with 1 to 12 C atoms, x is the number 1 or 2, and F is a functional group which is capable of reacting with the functional group of a dye, forming a covalent bond.

B is preferably a bivalent bridging group and x is preferably 1. B may for example be a linear or branched $C_1$–$C_{12}$alkylene and preferably $C_1$–$C_8$alkylene, $C_3$–$C_{12}$cycloalkylene and preferably $C_5$–$C_8$cycloalkylene, $C_1$–$C_4$alkylene-$C_5$–$C_8$cycloalkylene, $C_1$–$C_4$alkylene-$C_5$–$C_8$cycloalkylene-$C_1$–$C_4$alkylene, $C_6$–$Cl_2$arylene, $C_7$–$C_6$aralkylene, or $C_1$–$C_4$alkylene-$C_6$–$C_{12}$arylene-$C_1$–$C_4$alkylene.

Examples of alkylene are methylene, ethylene, and the isomers of propylene, butylene, pentylene, hexylene, heptylene, octylene, nonylene, decylene, undecylene and dodecylene.

Examples of cycloalkylene are cyclopropylene cyclobutylene, cyclopentylene, cyclohexylene, cycloheptylene, cyclooctylene and cyclododecylene. Cyclopentylene and cyclohexylene are preferred.

Examples of cycloalkylalkylene are cycloalkylmethylene or cycloalkylethylene. Examples of cycloalkyl-bis-alkylene are cycloalkyl-bis-methylene or cycloalkyl-bis-ethylene.

Examples of arylene are in particular phenylene and naphthylene. Examples of aralkylene are benzylene and phenylethylene. Examples of aryl-bis-alkylene are phenyl-bis-methylene and phenyl-bis-ethylene.

The functional group F may be selected from the group —CHO, —OH, —SH, —NHR, wherein R is hydrogen or $C_1$–$C_4$alkyl, —$CO_2H$, —$CO_2R_1$, —C(O)—$NR_2R_3$, —NCO, —$SO_3H$, —$SO_2OR$ and —$SO_2$—$NR_2R_3$, wherein $R_1$ is $C_1$–$C_4$alkyl, and $R_2$ and $R_3$ are independently of one another hydrogen or $C_1$–$C_4$alkyl. As alkyls, R, $R_1$, $R_2$ and $R_3$ are preferably methyl or ethyl.

The preferred functional groups are —CHO, —OH, —SH and —NHR, wherein R is hydrogen, methyl or ethyl. Of these functional groups, —CHO is especially preferred.

Very especially preferred compounds of formula I are those wherein B represents a direct bond or $C_1$–$C_8$alkylene and F is —CHO. Examples of these preferred compounds are glyoxal, malondialdehyde, glutardialdehyde, succinaldehyde, dialdehyde starch and mixtures of these dialdehydes.

The aldehyde groups may also be present as acetal or thioacetal derivatives.

In process step a2) penetration and retardation auxiliaries may in addition be added for functional organic compounds, for example high-molecular weight organic polyhydroxy compounds such as polysaccharides, saturated or unsaturated water-soluble alcohols or water-soluble polyacrylates. The added quantity may amount for example to 10 to 200, preferably 30 to 70 parts by weight, in relation to the functional organic compound.

Process Step b1)

The acidic medium in process step b1) may show a pH of for example 2.5 to 7, preferably 3 to 5.5. The pH may be adjusted by the addition of the requisite quantity of an inorganic or organic acid, for example a mineral acid or carboxylic acid. It is especially expedient to use formic acid or acetic acid. The process step is preferably carried out at temperatures of 20 to 70° C. and especially preferably 30 to 50° C. The polyfunctional organic compound may act for a period of for example 10 minutes to 2 hours, preferably 20 minutes to 1 hour. According to the invention, a relatively high penetration of the leather with the polyfunctional organic compound is achieved by treatment in the acidic medium. This can improve the penetration of the colouring. The quantities of polyfunctional organic compound used are given under process step a1).

In process step b1) all or part, for example up to 70%, of the polyfunctional organic compound is added. The partial quantity amounts to preferably 10 to 60 and especially preferably 20 to 50% of the total amount. If a partial amount is used, the remainder is used in accordance with process steps a1) and a2). For this, the liquor can first be neutralized with bases, for example with alkali metal or alkaline earth metal oxides, hydroxides or carbonates. It is more advantageous to neutralize with ammonia or a primary amine, as used in process step a1), using in addition the quantity required for neutralization.

It has also proved advantageous to use part of the dye or dyes to predye the leather already in process step b1). The partial amount used is preferably 10 to 60 and especially preferably 20 to 50% of the total amount. If a partial amount is used, the remainder is used in accordance with process steps a1) and c). For this, the liquor can first be neutralized with bases, for example with alkali metal or alkaline earth metal oxides, hydroxides or carbonates. It is more advantageous to neutralize with ammonia or a primary amine, as used in process step a1), using in addition the quantity required for neutralization. Then one can continue with process step c). The advantage of this process variant with prior partial dyeing consists in a further enhancement of colour intensity.

Process Step b2)

Process step b2) is carried out according to process step a1), where the liquor of process step b1) may previously be neutralized as described before.

Process Step c)

After the reaction of the leather with the ammonia or primary amine and a polyfunctional organic compound, a dye comprising functional groups which are capable of reacting with the functional groups of the polyfunctional organic compound, forming a covalent bond, is added to the reaction mixture. The quantity of the dye may amount, for example, to 0.1 to 20, preferably 0.5 to 15 and especially preferably 1 to 10 parts by weight, in relation to 100 parts by weight of the tanned leather (shaved weight). In process step c) the pH of the aqueous alkaline medium is preferably 7 to 10, especially preferably 7.5 to 9, and in particular preferably 8 to 9. The process is expediently carried out at elevated temperatures, for example 30 to 80° C., preferably 40 to 60° C. The dyeing of the leather may, for example, take up to 4 hours. In general, however, periods of up to about two hours are sufficient. If the pH value falls too far as a result of the use of ammonia in process step a2) or b2), the alkaline range is expediently adjusted by adding inorganic bases. The addition of borax, alkaline phosphate salts, alkaline earth metal and preferably alkali metal carbonates has proved particularly expedient. Magnesium, calcium, lithium, sodium and potassium carbonate, for example, are suitable. Preferably sodium and potassium carbonate are used. It is especially advantageous to mix the inorganic bases with the dye and add the mixture to the reaction mixture of process step c). The dyes can be used as powder, dispersions, emulsions or solutions.

A further object of the invention is a composition comprising an inorganic base, preferably an alkaline earth metal or preferably alkali metal carbonate, and a dye containing functional groups which are capable of reacting with the functional groups of the polyfunctional organic compound, forming a covalent bond. The quantity of dye may amount to, for example, 1 to 90, preferably 20 to 80, and especially preferably 30 to 70 parts by weight in relation to 100 parts by weight of the composition. The quantity of inorganic base may amount to, for example, 1 to 80, preferably 10 to 60 and especially preferably 15 to 50 parts by weight in relation to 100 parts by weight of the composition. The mixtures can be prepared in a manner known per se by mixing the solid components in a dry mixer. For the purpose of standardization, about 10 percent by weight of sodium sulfate can be added.

The compositions according to the invention may also be formed as kits in separate containers in appropriate amounts stipulated for the process according to the invention, where the dyes may also be present as aqueous solutions, dispersions or emulsions and the inorganic base as solution, for example as concentrates.

Dyes with functional groups are known, commercially available or capable of preparation by means of analogous processes. Organic and metal organic dyes are suitable. Examples are azo dyes, anthraquinone dyes, diarylmethane and triarylmethane dyes, sulfur dyes (in particular soluble sulfur dyes), and phthalocyanine dyes, as well as azine, oxazine and thiazine dyes. Azo dyes (mono, bis, tris, tetrakis and polyazo dyes) and metal complex azo dyes are especially preferred. Various dyes of these classes have been described in the literature and in many cases are commercially available. Functional groups can be introduced according to known methods. The dyes often already contain functional groups. Azo dyes and metal complex azo dyes are preferred because coupling components are used in their synthesis which already contain several amino groups, such as H-acid, γ-acid, I-acid, and in particular metaphenylenediamine, 2,4-diaminotoluene, and 1,3-diaminobenzene-6-sulfonic acid.

The dyes comprise at least one functional group which is capable of reacting with a functional group of the polyfunctional organic compound. The functional group may be bonded to the backbone chain of the dye either directly or via a bridging group, for example an alkylene or arylene group. If the reactivity of functional groups bonded to aromatic rings is too weak or the introduction of a different functional group is desired, these functional groups are generally reacted with functional groups using chain extenders. This method is known and is described in the literature. Dyes often comprise more than one, identical or different functional groups, but in the process according to the invention they do not all have to react and form covalent bonds. The functional group may be selected from the group —CHO, —OH, —SH, —NHR, wherein R is hydrogen or $C_1$–$C_4$alkyl, —$CO_2H$, —$CO_2R_1$, —C(O)—$NR_2R_3$, —NCO, —$SO_3H$, —$SO_2OR_1$, and —$SO_2$—$NR_2R_3$, wherein $R_1$ is $C_1$–$C_4$alkyl, and $R_2$ and $R_3$ are independently of one another hydrogen or $C_1$–$C_4$alkyl. As alkyls, R, $R_1$, $R_2$ and $R_3$ are preferably methyl or ethyl.

Preferred functional groups are —OH, —SH and —NHR, wherein R is hydrogen, methyl or ethyl. The —$NH_2$ group, which can form covalent bonds with aldehyde, ester or amide groups, is quite particularly preferred.

Preferred dyes may also correspond to formula II, $$\text{Dye-(X-Z)}_y \qquad \text{(II)},$$

wherein dye is the backbone chain of a water-soluble, organic or metal organic dye, X is a direct bond or a bivalent bridging group, Z is a functional group which is capable of reacting with the functional groups of the polyfunctional organic compound, forming a covalent bond, and y is a number from 1 to 10.

The bridging group is preferably $C_1$–$C_{12}$alkylene, which may be broken by O, S or NR, where R is H or $C_1$–$C_4$alkyl.

In formula II, Z is preferably —OH, —SH and —$NH_2$, whereby $NH_2$ is quite particularly preferred.

In formula II, y is a number from 1 to 6, especially preferably 1 to 4.

An especially preferred group of dyes are black dyes of formulae III, IV, V, VI, VII, VIII and IX, (III)

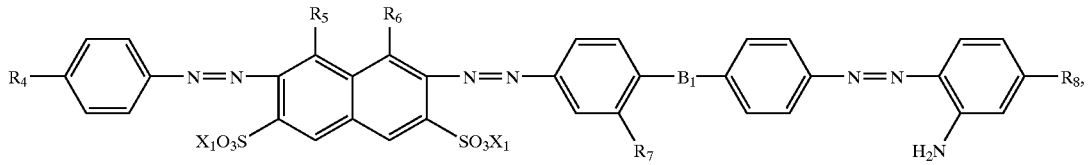

(IV)

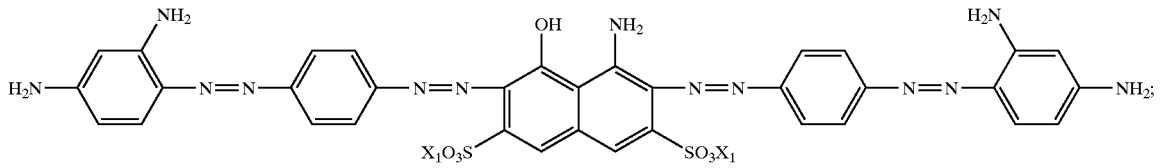

(V)

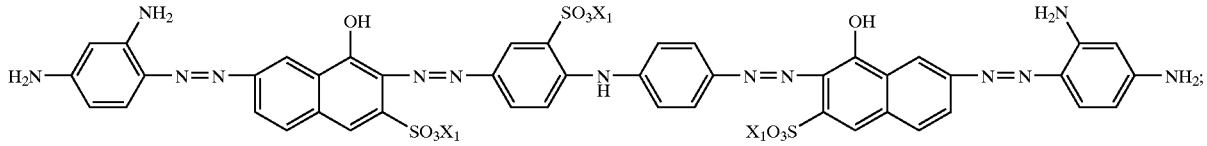

-continued (VI)

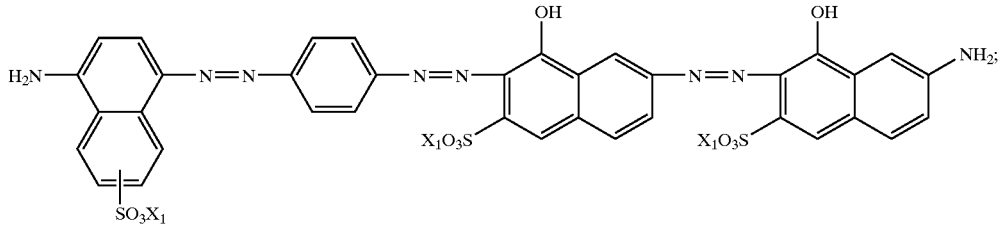

(VII)

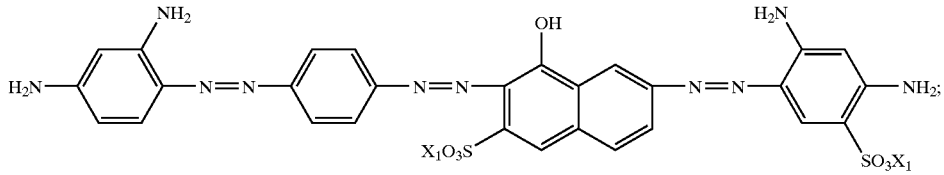

(VIII)

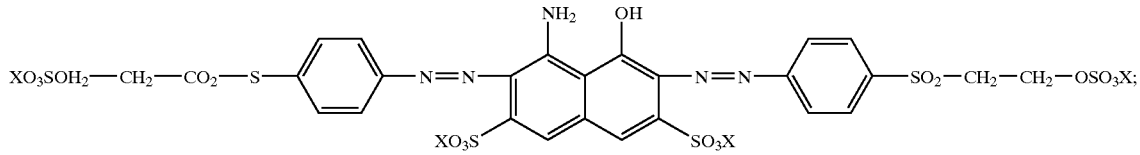

and (IX)

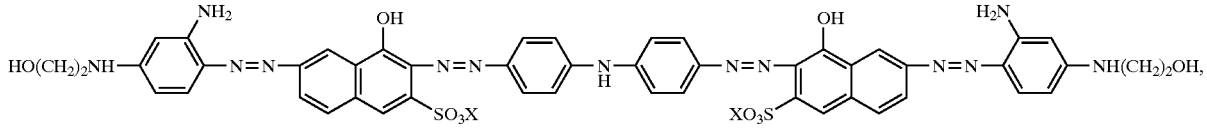

wherein $R_4$ is hydrogen or —$NO_2$;

$R_5$ and $R_6$ are independently of one another —$NH_2$ or —OH;

$R_7$ hydrogen or if necessary salted —$SO_3H$;

$R_8$ is —$NH_2$ or —OH;

$B_1$ is —$SO_2NH$—, —$SO_2$—, —NH—, —N═N— or —CONH—; and the $X_1$ are independently of one another H or an alkali metal.

Another especially preferred group of dyes are brown dyes of formulae X, XI and XII, (X)

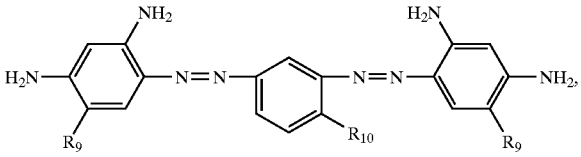

(XI)

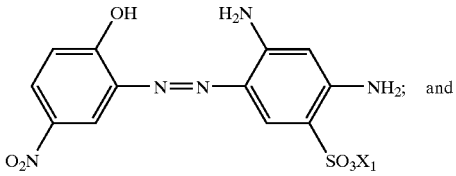

and

-continued (XII)

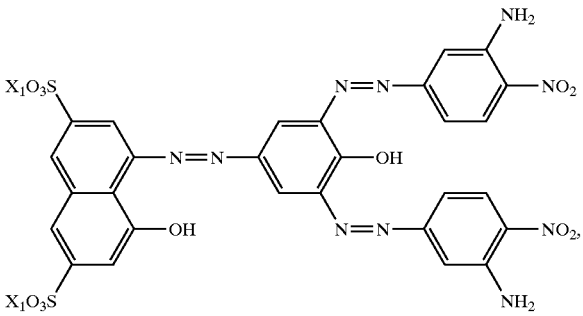

wherein $R_9$ is hydrogen or methyl; and $R_{10}$ is hydrogen, methyl or methoxy, and $X_1$ is H or an alkali metal.

A further especially preferred group of dyes are the blue dyes of formulae XIII, XIV and XV, (XIII)
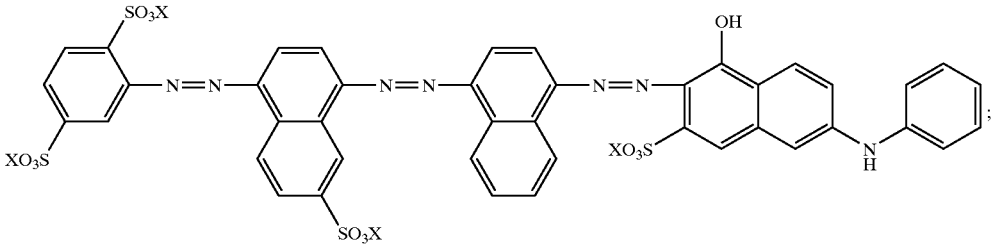
(XIV)
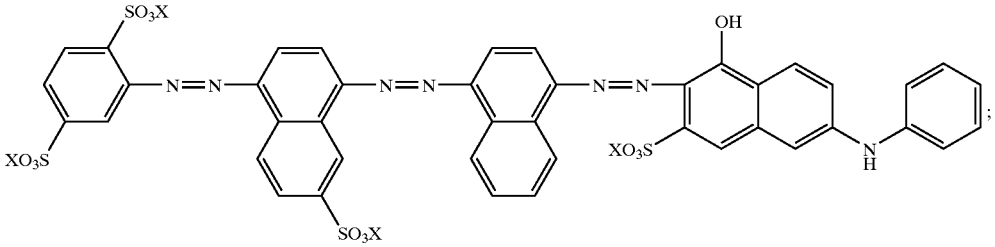
(XV)
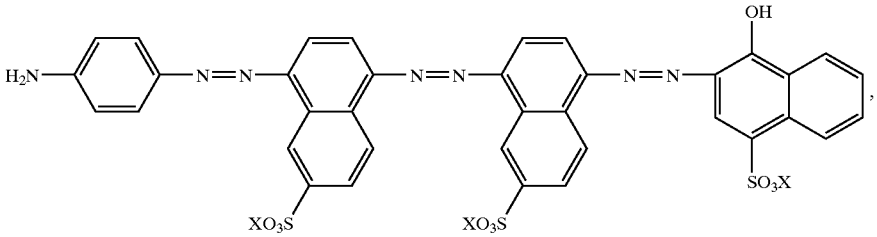
wherein X is H or an alkali metal.
Likewise especially preferred are the yellow dye of formula XVI and the red dye of formula XVII,
(XVI)
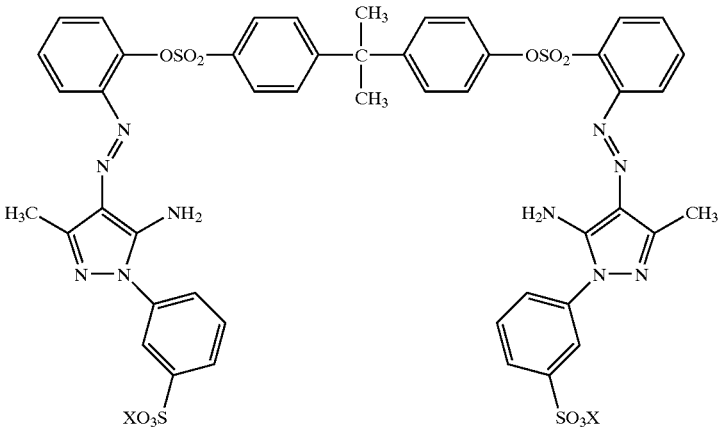

-continued (XVII)

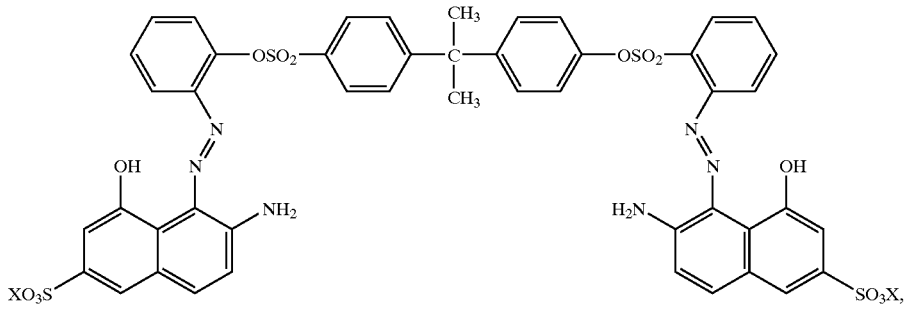

wherein X is H or an alkali metal.

Especially preferred dyes can be obtained generally by selective reduction of nitro groups in dyes. In this way, the brown dyes of formulae XX and XXI can be obtained from the brown dyes of formulae XVIII and XIX, (XVIII)

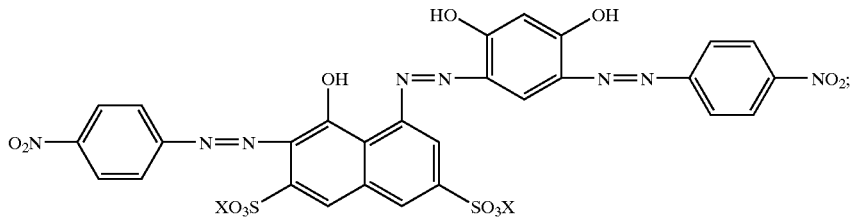

(XIX)

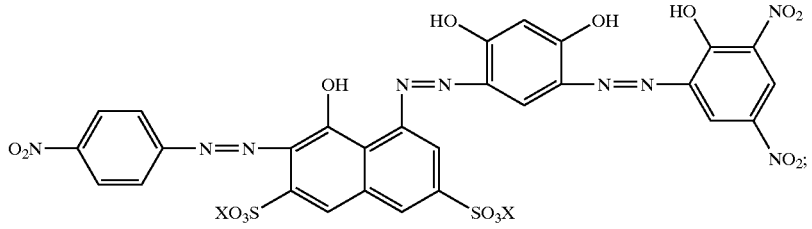

(XX)

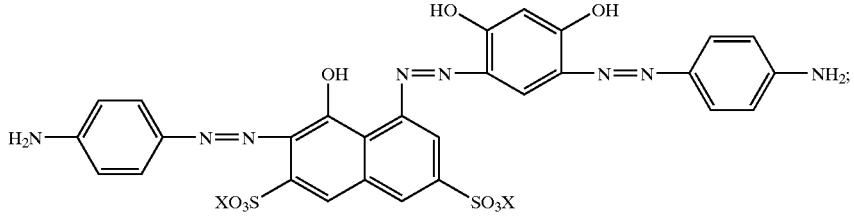

(XXI)

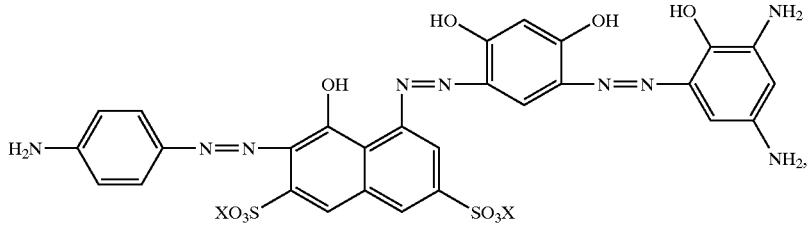

wherein X is H or an alkali metal.

According to the invention, sulfur dyes can also be used at the same time in step c) which are not covalently bonded, but which ensure good penetrate of the leather. The quantity of dye may for example be 0.1 to 20, preferably 0.5 to 15 and especially preferably 1 to 10 parts by weight, in relation to 100 parts by weight of tanned leather (shaved weight). This high level of wet fastness achieved is not compromised as a result, and furthermore the surface even shows a slightly higher degree of colour intensity. Sulfur dyes are known and commercially available.

Process Step d)

After dyeing, the liquor is drained and the leather washed with water. The washing temperature may range for example from room temperature to about 60° C. It is advantageous to perform the washing process in several steps, until the washings show only minimal, if any, colour. It is advantageous to add formic acid to the last washing step. The amount added may for example be 0.1 to 5 parts by weight, in relation to 100 parts by weight of tanned leather (shaved weight).

Using the process according to the invention, dyed leather is obtainable with substantially higher colour intensity than when dyeing in an acidic medium. Surprisingly, the colour fastness is also extremely high, so that further wet processing of the leather is possible without any problem and without any loss of colour intensity. These properties are of considerable importance for further processing of the leather, such as retanning, fatliquoring or softening, or for penetration of the leather. Using a process according to the invention, leather is obtainable in which the dye is essentially bonded in the surface region. The depth of penetration of the covalently bonded dye may for example be about 0.5 to 1 mm. If colouring of the leather core is also desired, pre or post-dyeing may be carried out with state-of-the-art methods using anionic dyes, without the loss of colour intensity.

For the colour intensity achieved, the wet fastness (for example fastness to perspiration, washing and water) is outstanding and far superior to that in leather produced using standard dyeing processes. The degree of bleeding from leather to substrates such as textile materials (for example, cotton or wool) can be measured using a grey rating scale from 1 (poor, colouring of substrate) to 5 (excellent, no colouring of substrate). Leather produced according to the invention shows a value of 4 to 5, whereas leather dyed using state-of-the-art techniques without any special treatment shows values of 1 to 3.

A very particular advantage of the process according to the invention is that, as a result of the high degree of grain tightness that can be achieved, larger quantities of waterproofing agents and fat liquors can be taken up by the leather without any negative effect on grain quality. In the process, the liquors may even show a higher pH than is otherwise customary, for example pH 5 or higher. The agents chiefly used as emulsions do not break down at these pH values, but only when they come into contact with the leather, which is more alkaline in its microenvironment as a result of the alkaline pretreatment. With the outstanding tightness of grain in leather dyed according to the invention, larger quantities of the said agents can be absorbed, so that softness and waterproofing are adjustable.

A further object of the invention is a dyed leather that is not anionic tanned or retanned and wherein the dye is permanently and covalently bonded to the leather via a bridging group, preferably in the region of the surface, and the bridging group is essentially bonded to the leather via —N═CH groups.

A tanned and dyed leather in which numerous groups of formula XXII are bonded covalently in the region of the surface is preferred.

—N═CH—B—(Y—X-dye)$_r$, (XXII), wherein

B is a direct bond or a bivalent or trivalent bridging group with 1 to 12 C atoms, X is a direct bond or a bivalent bridging group, r is the number 1 or 2, and Y is a group formed from a functional group of a polyfunctional organic compound and a functional group of a dye.

In formula XXII, r is preferably 1. X is preferably a direct bond. If X is a bridging group, it is preferably $C_1$–$C_{12}$alkylene, which may be broken by O, S or NR, where R is H or $C_1$–$C_4$alkyl.

B is preferably a bivalent bridging group and r is preferably the number 1. B may for example be linear or branched $C_1$–$C_{12}$alkylene and preferably $C_1$–$C_8$alkylene, $C_3$–$C_{12}$cycloalkylene and preferably $C_5$–$C_8$cycloalkylene, $C_1$–$C_4$alkylene-$C_5$–$C_3$cycloalkylene, $C_1$–$C_4$alkylene-$C_5$–$C_8$cycloalkylene-$C_1$–$C_4$alkylene, $C_6$–$C_{12}$arylene, $C_7$–$C_{16}$aralkylene, or $C_1$–$C_4$-alkylene-$C_6$–$C_{12}$arylene-$C_1$–$C_4$alkylene. Preferences and examples are indicated hereinbefore.

The structure of group Y depends on which functional groups are selected and reacted with one another. They may for example be imine, ester, amide, urea and urethane groups. Examples of these groups are —HC═N—, —N—CH—, —C(O)—O—, —O—C(O)—, —C(O)—S—, —S—C(O)—, —C(O)—NR—, —NR—C(O)—, —NH—C(O)—NR—, —NR—C(O)—NH—, —O—C(O)—NR—, —NR—C(O)—O—, —S—C(O)—NR—, and —NR—C(O)—S—. The —CH═NH— group is quite especially preferred.

A preferred subgroup of formula XXII groups is one wherein B is a bivalent bridging group with 1 to 8 C atoms, X is a direct bond, Y is —HC═N—, and r is the number 1.

For the dye groups in formula XXII, the embodiments and preferences described herein-before apply.

The following examples explain the invention in more detail.

A) EXAMPLES OF MANUFACTURE

Example A1

Dyeing with the Black Dye of Formula XXIII (XXIII)

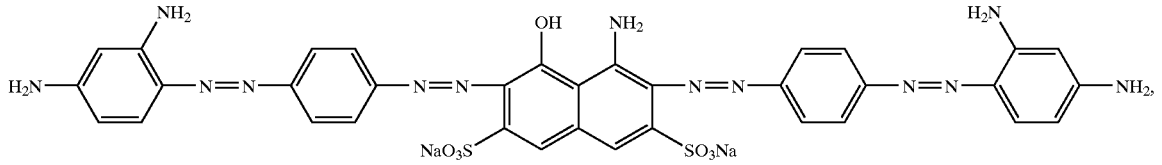

Essentially via —N═CH groups means in the context of the invention that the covalent bonding to the leather takes place only or predominantly via imine groups. Other conceivable covalent bonds, present on a lesser scale, are piperidine groups and C—C bonds resulting from Michael reactions.

i) Pretreatment of Leather 100 parts by weight of chrome-tanned cattlehide (shaved weight) is washed at 40° C. for 10 minutes in 200 parts by weight of water containing 0.5 parts by weight of a wetting agent (sulfated fatty alcohol), and the water and wetting agent are then removed. The leather is then neutralized for 40 minutes in a liquor comprising 100 parts by weight of water, 2 parts by weight of ammonium bicarbonate and 2 parts by weight of sodium formate. The neutralization agent is removed and the leather then washed for 10 minutes at 500C with 200 parts by weight of water. The washings are removed and the leather prepared in this way is used in the next step.

ii) Reaction with Ammonia

A liquor of 50 parts by weight of water and one part by weight of 24% ammonia is prepared and the leather treated for 10 minutes at 50° C.

iii) Reaction with Glutardialdehyde

At unchanged temperature, 5 parts by weight of a mixture of 23 parts by weight of glutardialdehyde and 11 parts by weight of polysaccharide is added to the liquor. This is then allowed to act on the leather for 30 minutes.

iv) Reaction with the Dye

To the liquor described under iii), 4 parts by weight of black dye of formula XXIII is added and allowed to react for 90 minutes at 50° C. Then 2 parts by weight of sodium carbonate is added and the dye liquor then maintained at the same temperature for another 60 minutes.

v) Washing of Dyed Leather

The dye liquor is drained and the dyed leather washed for 10 minutes twice with 200 parts by weight of water each time, the temperature being first 50° C., then 40° C. in the second and third washing process, and 0.5 parts by weight of 85% formic acid is added in the third washing step to reduce the pH of the leather. The washings are drained off and a black dyed leather obtained with a high degree of colour intensity and excellent wet fastness, which can then be finished in the customary manner.

Example A2

The procedure is as described under example A1, except that in process step ii) 1.5 parts by weight of ammonium sulfate and 2.4 parts by weight of magnesium oxide are used instead of ammonia. A black dyed leather with a high degree of colour intensity and excellent wet fastness is obtained.

Example A3

The procedure is as described under example A1, except that in process step ii) 2 parts by weight of ammonium bicarbonate and 3 parts by weight of sodium bicarbonate are used instead of ammonia. A black dyed leather with a high degree of colour intensity and excellent wet fastness is obtained.

Example A4

The procedure is as described under example A1, except that in process step ii) 1.5 parts by weight of ammonium chloride and 3 parts by weight of borax are used instead of ammonia. A black dyed leather with a high degree of colour intensity and excellent wet fastness is obtained.

Example A5

The procedure is as described under example A1, except that in process step ii) 2 parts by weight of the mixture described under example C1 is used instead of ammonia. A black dyed leather with a high degree of colour intensity and excellent wet fastness is obtained.

Example A6

The procedure is as described under example A1, except that in process step ii) 2 parts by weight of the mixture described under example C2 is used instead of ammonia. A black dyed leather with a high degree of colour intensity and excellent wet fastness is obtained.

Example A7

The procedure is as described under example A1, except that in process step ii) 2 parts by weight of the mixture described under example C3 is used instead of ammonia. A black dyed leather with a high degree of colour intensity and excellent wet fastness is obtained.

Example A8

The procedure is as described under example A1, except that in process step ii) 2 parts by weight of the mixture described under example C4 is used instead of ammonia. A black dyed leather with a high degree of colour intensity and excellent wet fastness is obtained.

Example A9

The procedure is as described under example A1, except that in process step ii) 2 parts by weight of the mixture described under example C5 is used instead of ammonia. A black dyed leather with a high degree of colour intensity and excellent wet fastness is obtained.

Example A10

Preparation of a sheepskin with excellent wet fastness, a high degree of colour intensity and outstanding grain quality z the basis for clothing leather.

i) Pretreatment of Leather 100 parts by weight of chrome-tanned sheepskin (shaved weight) is washed for 10 minutes at 50° C. in 200 parts by weight of water and 2 parts by weight of 24% ammonia and the water then removed.

ii) Reaction with an Alkalizing and Ammonia-Liberating Mixture

A liquor of 200 parts by weight of water and one part by weight of a mixture as described under example C5 is prepared and the leather treated for 10 minutes at 50° C.

iii) Reaction with Glutardialdehyde

At unchanged temperature, 3 parts by weight of a mixture of 23 parts by weight of glutardialdehyde and 11 parts by weight of polysaccharide are now added to the liquor. This is then allowed to act on the leather for 20 minutes.

iv) Reaction with the Dye

To the liquor described under iii), 6 parts by weight of black dye as described under example C6 is added and allowed to react for 60 minutes at 50° C. Then 3 parts by weight of 85% formic acid is added in 3 portions over a period of 20 minutes and the dye liquor then maintained at the same temperature for another 30 minutes.

e) Washing of Dyed Leather

The almost colourless dye liquor is drained and the dyed leather washed for 10 minutes at 50° C. with 200 parts by weight of water and 0.5 parts by weight of 85% formic acid. The washings are drained off and a black dyed leather obtained with a high degree of colour intensity, which can then be retanned, fatliquored and finished in the manner that is customary with clothing leather. As a result of the markedly improved wet fastness compared with conventionally manufactured leather, equipment is subject to far less contamination from bleeding of the dyed leather during the further treatment process.

A washing test of the finished leather at 40° C. in a solution of 0.4 parts by weight of washing powder (ECE77)

in water showed substantially less coloured washing liquor after 30 minutes versus a conventionally manufactured deep-black leather. The water that runs off when the wet leather is set out is almost colourless. A leather is obtained showing excellent wet fastness, a high degree of colour intensity and outstanding grain quality as the basis for leather clothing intended.

Example A11

Preparation of cattlehide with excellent wet fastness, a high degree of colour intensity and outstanding grain tightness as the basis for waterproofed shoe upper leather.

i) Pretreatment of Leather 100 parts by weight of chrome-tanned cattlehide (shaved weight) is washed for 10 minutes at 40° C. in 200 parts by weight of water and the water then removed. The leather is then treated for 60 minutes with a dye liquor comprising 50 parts by weight of water, 0.5 parts by weight of ammonium bicarbonate and 3 parts by weight of sodium formate and 1 part by weight of a black dye mixture as described under C6.

ii) Reaction with an Alkalizing and Ammonia-Liberating Mixture

Four parts by weight of a mixture according to example C5 is added to this liquor and the leather treated for 20 minutes at 40° C.

iii) Reaction with Glutardialdehyde

At unchanged temperature, 4 parts by weight of a mixture of 23 parts by weight of glutardialdehyde and 11 parts by weight of polysaccharide are added to the liquor. This is then allowed to act on the leather for 20 minutes.

iv) Reaction with the Dye

To the liquor described under iii), 3 parts by weight of black dye mixture as described under example C6 and 2 parts by weight of a water-soluble penetrating black sulfur dye (C.I. Solubilized Sulfur Black 1) is added and allowed to act for 20 minutes at 40° C. Then 2 parts by weight of a formulation of emulsified, neutral, synthetic oils with a waterproofing action (EUPILON® WAS-1, TFL Ledertechnik GmbH & Co. KG) is added and the dye liquor then maintained at the same temperature for 60 minutes.

v) Washing of Dyed Leather

The dye liquor is drained and the dyed leather washed twice for 10 minutes at 40° C. with 200 parts by weight of water each time, 0.5 parts by weight of 85% formic acid being added in the second washing process to reduce the pH of the leather. The washings are drained off and a black dyed leather obtained with a high degree of colour intensity, excellent wet fastness and grain tightness, which may then be further waterproofed, retanned and finished in a-manner-customary for waterproofed shoe upper leather (seeexample82).

Example A12

Preparation of cattlehide with excellent wet fastness, a high degree of colour intensity and outstanding grain tightness as the basis for a full-grained leather intended for shoes.

i) Pretreatment of Leather 100 parts by weight of chrome-tanned cattlehide (shaved weight) is washed for 10 minutes at 40° C. in 200 parts by weight of water and the water then removed. The leather is then treated for 20 minutes with a dye liquor comprising 50 parts by weight of water and 2 parts by weight of a black dye mixture as described under C6.

ii) Reaction with an Alkalizing and Ammonia-Liberating Mixture

Four parts by weight of a mixture according to example C5 is added to this liquor and the leather treated for 20 minutes at 40° C.

iii) Reaction with Glutardialdehyde

At unchanged temperature, 4 parts by weight of a mixture of 23 parts by weight of glutardialdehyde and 11 parts by weight of polysaccharide are added to the liquor. This is then allowed to act on the leather for 20 minutes.

iv) Reaction with the Dye

To the liquor described under iii), 3 parts by weight of black dye mixture as described under example C10 and 1 part by weight of a water-soluble penetrating black sulfur dye (C.I. Solubilized Sulfur Black 1) is added and allowed to act for 60 minutes at 40° C.

v) Washing of Dyed Leather

The dye liquor is drained and the dyed leather washed twice for 10 minutes at 40° C. with 200 parts by weight of water each time, 0.5 parts by weight of 85% formic acid being added in the second washing process to reduce the pH of the leather. The washings are drained off and a black dyed leather obtained with a high degree of colour intensity and excellent grain tightness, which can then be retanned, fatliquored and finished in the manner that is customary with shoe upper leather.

Example A13

Preparation of a cattlehide with excellent wet-fastness, a high degree of colour intensity and outstanding grain quality as the basis for furniture leather. Improvement of glutaraldehyde penetration by prior use at an acidic pH.

i) Pretreatment of Leather 100 parts by weight of chrome-tanned cattlehide (shaved weight) is washed for 10 minutes at 40° C. in 300 parts by weight of water and the water then removed.

ii) Reaction with Glutaraldehyde at Acidic DH

The leather is then treated for 40 minutes in a liquor comprising 100 parts by weight of water and 1 part by weight of formic acid at a pH of about 3.5 and a temperature of 40° C. with 4 parts by weight of a mixture of 23 parts by weight of glutardialdehyde and 11 parts by weight of polysaccharide.

iii) Reaction with an Alkalizing and Ammonia-Liberating Mixture

To the liquor described under ii), 5 parts by weight of the mixture as described under example C2 is added at unchanged temperature. This is then allowed to act on the leather for 20 minutes.

iv) Reaction with the Dye

To the liquor described under iii), 5 parts by weight of the dye mixture as described under example C10 is added and allowed to react for 90 minutes at 40° C. To reduce the pH, the leather is then treated twice with 1.5 parts by weight of formic acid for 30 minutes each time.

v) Washing of Dyed Leather

The dye liquor is drained and the dyed leather washed twice for 10 minutes at 40° C. with 300 parts by weight of water each time. The washings are drained off and a black dyed leather obtained with a high degree of colour intensity and outstanding wet fastness, which can then be finished in the customary manner by retanning, fatliquoring and dressing.

Example A14

Preparation of a cattlehide with excellent wet fastness, a high degree of colour intensity and outstanding grain quality as the basis for furniture leather. Improvement in glutaraldehyde penetration by prior use at acidic pH and increase in colour intensity by prior application of part of the total volume of dye.

i) Pretreatment of Leather 100 parts by weight of chrome-tanned cattlehide (shaved weight) is washed for 10 minutes at 40° C. in 300 parts by weight of water and the water then removed.

ii) Reaction with Glutaraldehyde at Acidic pH

The leather is then treated for 40 minutes in a liquor comprising 100 parts by weight of water and 1 part by weight of formic acid at a pH of about 3.5 and a temperature of 40° C. with 4 parts by weight of a mixture of 23 parts by weight of glutardialdehyde and 11 parts by weight of polysaccharide.

iii) Reaction with Part of the Total Volume of Dye

To the liquor described under ii), 2 parts by weight of the dye mixture as described under example C10 is added and the leather treated for 20 minutes at 40° C.

iv) Reaction with an Alkalizing and Ammonia-Liberating Mixture

To the liquor described under iii), 5 parts by weight of the mixture as described under example C2 is added at unchanged temperature. This is then allowed to act on the leather for 20 minutes.

v) Reaction with the Remaining Volume of Dye

To the liquor described under iv), 3 parts by weight of the dye mixture as described under example C7 is added and allowed to react for 90 minutes at 40° C. To reduce the pH, the leather is then treated twice with 1.5 parts by weight of formic acid for 30 minutes each time.

vi) Washing of Dyed Leather

The dye liquor is drained and the dyed leather washed twice for 10 minutes at 40° C. with 300 parts by weight of water each time. The washings are drained off and a black dyed leather obtained with a very high degree of colour intensity and outstanding wet fastness, which can then be finished in the customary manner by retanning, fatliquoring and dressing.

Example A15

Preparation of a non-chrome-tanned cattlehide with very good wet fastness, good colour intensity and outstanding grain quality as the basis for furniture leather.

100 parts by weight of cattlehide tanned with glutaraldehyde in the customary manner is treated as described under Example A14. A black dyed leather is obtained with comparatively very good colour intensity and outstanding wet fastness, which can then be retanned, fatliquored and finished to produce a chrome-free furniture leather.

B) Examples of Use

Example B1

Fatliquoring of Leather

The dyed leather is treated for 30 minutes at 40° C. in a fresh liquor comprising 100 parts by weight of water and 0.5 parts by weight of formic acid. The liquor is drained off, 100 parts by weight of water and then 4 parts by weight of a synthetic fat liquor (mixture of sulfonated aliphatic hydrocarbons, fatty acids and derivatives thereof are added and the leather then treated for 30 minutes at 40° C. At an interval of 10 minutes and at unchanged temperature, 1 part by weight of formic acid is then added and treatment continued for 20 minutes. The liquor is then drained off and, after washing, the leather is finished in the customary manner. The dyed and fatliquored leather shows practically no loss of its original colour intensity.

With IR spectroscopy (or Raman spectroscopy) the bands characteristic of imine groups are measured at 1640 to 1690 $cm^{-1}$.

Example B2

Finishing of Leather as Described Under Example A11 as Shoe Upper Leather i) Waterproofing and Retanning A liquor comprising 100 parts by weight of water, calculated with reference to the shaved weight of the leather used, 3 parts by weight of a polyacrylate with dispersive properties (MAGNOPAL® FN new, TFL Ledertechnik GmbH & Co. KG), 2 parts by weight of a polyacrylate with softening properties (MAGNOPAL® SOF) and 10 parts by weight of a formulation of emulsified, neutral, synthetic oils with a waterproofing action (EUPILON® WAS-1) is prepared and the leather from example A11 treated for 40 minutes at 40° C. Then 4 parts by weight of a tanning chestnut extract is added and allowed to act for another 40 minutes. Two portions of 1.5 parts by weight each of 85% formic acid are added and treated for 10 minutes each. To fix the waterproofing agent, 1.5 parts by weight of a 33% basified chromium sulfate is added and allowed to act for 20 minutes.

ii) Post-Waterproofing

After draining of the liquor, 0.5 parts by weight of a polyacrylate with dispersive properties (MAGNOPAL® FN new), 2 parts by weight of a polyacrylate with softening properties (MAGNOPAL® SOF) and 2 parts of a formulation of emulsified, neutral, synthetic oils with a waterproofing action (EUPILON® WAS-1) are added to a new liquor of 200 parts by weight of water. The leather is treated in this liquor for 30 minutes at 40° C. and then acidified with 0.5 parts by weight of 85% formic acid within 10 minutes.

ii) Fixation

The liquor is drained and the leather treated for 10 minutes at 40° C. in a new liquor comprising 100 parts by weight of water and 0.2 parts by weight of 85% formic acid. Then 4 parts by weight of a 33% basified chromium sulfate is added and allowed to act for 60 minutes.

iv) Washing

The liquor is drained and the dyed and waterproofed leather washed twice for 10 minutes at 20° C. with 300 parts by weight of water each time. The leather is dried and finished in the customary manner and a black dyed shoe upper leather obtained with a high degree of colour intensity, outstanding wet fastness of the colour, excellent grain tightness and waterproofing properties markedly surpass those of leather manufactured under conventional conditions in terms of levelness and water-repellent action.

C) Manufacture of Mixtures According to the Invention

Example C1

Ammonium Salt of a Polymeric Acid with a Basic Compound 50 parts by weight of an ammonium salt of a homopolymer of acrylic acid with a weight average of molecular mass of 8000 daltons (determined by means of gel permeation chromatography) is dry mixed with 40 parts by weight of sodium carbonate and 10 parts by weight of sodium sulfate.

Example C2

Sodium Salt of a Polymeric Acid with Ammonium Chloride and a Basic Compound 30 parts by weight of a sodium salt of a homopolymer of acrylic acid with a weight average of molecular mass of 8000 daltons (determined by means of gel permeation chromatography) is dry mixed with 25 parts by weight of ammonium chloride, 38 parts by weight of sodium carbonate and 7 parts by weight of sodium sulfate.

Example C3

Sodium Salt of a Polymeric Acid with Ammonium Chloride and Borax 30 parts by weight of a sodium salt of a homopolymer of acrylic acid with a weight average of molecular mass of 8000 daltons (determined by means of gel permeation chromatography) is dry mixed with 25 parts by weight of ammonium chloride, 37.5 parts by weight of borax and 7 parts by weight of sodium sulfate.

Example C4

Sodium Salt of a Polymeric Acid with Ammonium Bicarbonate 30 parts by weight of a sodium salt of a homopolymer of acrylic acid with a weight average of molecular mass of 8000 daltons (determined by means of gel permeation chromatography) is dry mixed with 25 parts by weight of sodium carbonate, 37.5 parts by weight of ammonium bicarbonate and 7.5 parts by weight of sodium sulfate.

Example C6

Dye Mixture with Alkali Metal Carbonate 16.5 parts by weight of the dye of formula XXIII, 16.5 parts by weight of the dye of formula XXIV, 14 parts by weight of the dye of formula XXV and 6 parts by weight of the brown dye of formula XXVI as nuancing component are dry mixed with 37.5 parts by weight of sodium carbonate and 9.5 parts by weight of sodium sulfate.

(XXIII)

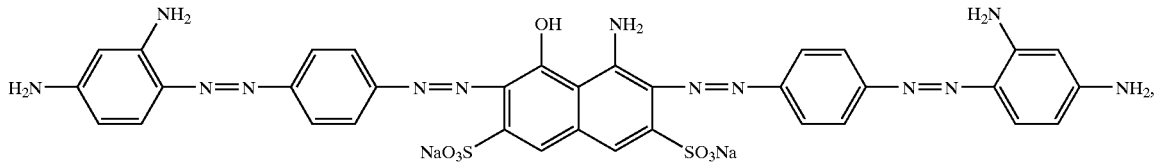

(XXIV)

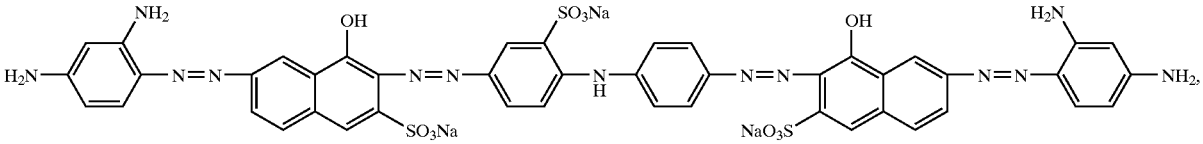

(XXV)

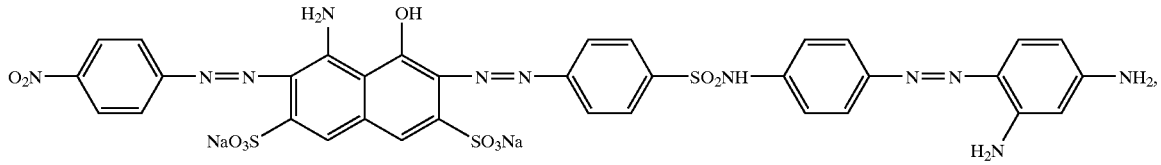

(XXVI)

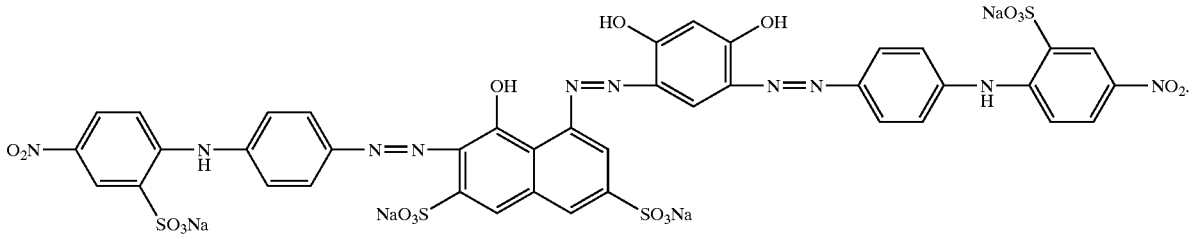

Example C5

Sodium Salt of a Polymeric Acid with Ammonium Sulfate 20 parts by weight of a sodium salt of a homopolymer of acrylic acid with a weight average of molecular mass of 8000 daltons (determined by means of gel permeation chromatography) is dry mixed with 25 parts by weight of magnesium oxide, 40 parts by weight of ammonium sulfate and 15 parts by weight of sodium sulfate.

Example C7

Dye Mixture 16.5 parts by weight of the dye of formula XXIII, 16.5 parts by weight of the dye of formula XXIV, 14 parts by weight of the dye of formula XXV and 6 parts by weight of the brown dye of formula XXVI as nuancing component are dry mixed with 47 parts by weight of sodium sulfate.

Example C8

Dye Mixture with Alkali Metal Carbonate 16.5 parts by weight of the dye of formula XXIII, 16.5 parts by weight of the dye of formula XXIV, 14 parts by weight of the dye of formula XXV and 15 parts by weight of the dye of formula XXVII as nuancing component are dry mixed with 30 parts by weight of sodium carbonate and 8 parts by weight of sodium sulfate.

Example C10

Dye Mixture with Alkali Metal Carbonate 17.5 parts by weight of the dye of formula XXIII, 17.5 parts by weight of the dye of formula XXIV, and 15 parts by weight of the dye of formula XXV are dry mixed with 40 parts by weight of sodium carbonate and 10 parts by weight of sodium sulfate.

(XXVII)

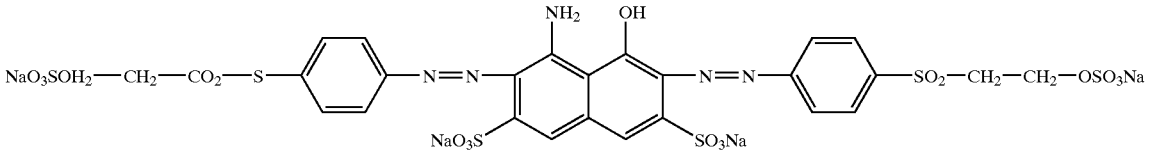

Example C9

Dye Mixture with Alkali Metal Carbonate 16.5 parts by weight of the dye of formula XXIII, 16.5 parts by weight of the dye of formula XXIV, 14 parts by weight of the dye of formula XXV and 15 parts by weight of the dye of the water-soluble penetrant black sulfur dye C.I. Solubilized Sulfur Black 1 are dry mixed with 30 parts by weight of sodium carbonate and 8 parts by weight of sodium sulfate.

Example D1

Manufacture of an Especially Preferred Dye by Selective Reduction of a Dye Containing a Nitro Group A mixture of equal parts of the dyes of formulae XXVIII and XXIX is obtained in the customary manner by diazotization and azo coupling of 59 parts by weight of 8-amino-1-naphthol-3,6-disulfonic acid to resorcinol and subsequent separate diazotization and azo coupling of 36 parts by weight of 4-nitroaniline and 19 parts by weight of 6-amino-2,4-dinitro-phenol. At 80° C. and a pH of 10.5, 50 parts by weight of glucose is added to the mixture and stirred for one hour. The reaction mass, comprising a mixture of equal parts of dyes XXX and XXXI, can be used directly for dyeing leather through the application of the process according to the invention, which produces colours with improved wet fastness versus the mixture of dyes XXVIII and XXIX.

(XXVIII)

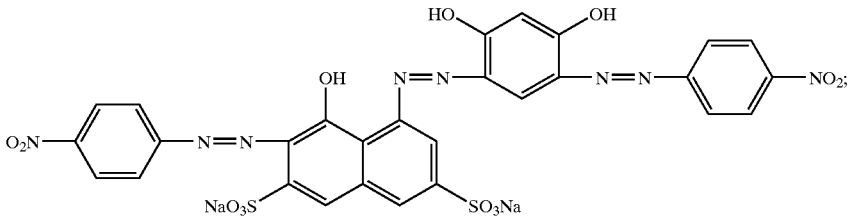

(XXIX)

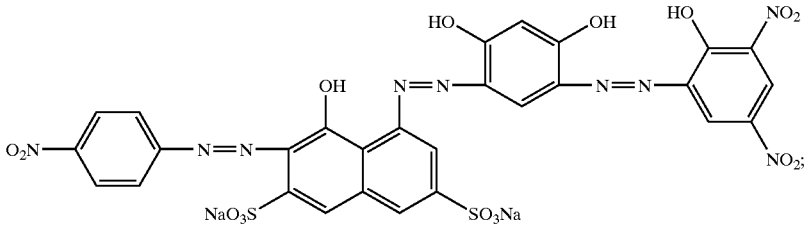

-continued (XXX)

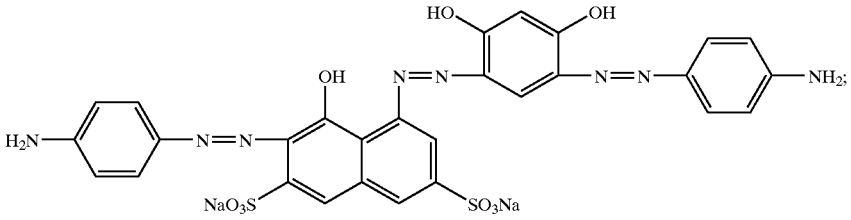

(XXXI)

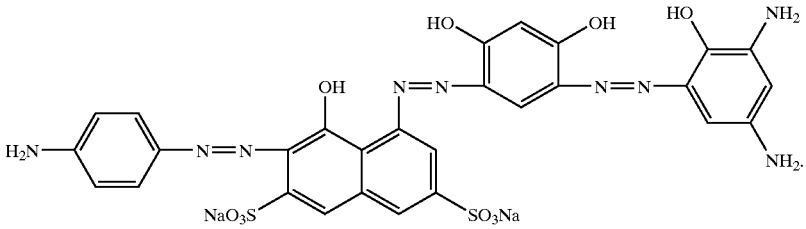

What is claimed is:

1. A process for dyeing tanned leather, which comprises either (a1) allowing ammonia, primary amines or a mixture of ammonia and primary amines in an aqueous and alkaline medium to act on the tanned leather and (a2) treating this leather in an aqueous and alkaline medium in the presence of ammonia, primary amines or a mixture of ammonia and primary amines with a polyfunctional organic compound comprising at least one aldehyde group as a functional group, or (b1) allowing a part or all of a polyfunctional organic compound comprising at least one aldehyde group as a functional group to act on the tanned leather in an aqueous and acidic medium and (b2) allowing ammonia, primary amines or a mixture of ammonia and primary amines in an aqueous and alkaline medium and then, if necessary, the remainder of the polyfunctional organic compound to act on the tanned leather;

(c) allowing a dye comprising at least one functional group to act on the treated leather in an aqueous and alkaline medium, wherein this functional group is capable of reacting with one of the functional groups of the organic compound forming a covalent bond; and (d) draining the dye liquor and washing the dyed leather with water with the proviso that the pH value in (c) is over 8 when using an anionic tanned or retanned leather, if an anionic dye is used.

2. A process according to claim 1, wherein the aqueous, alkaline medium in a1), a2), b2) and c) has a pH of 7 to 10.

3. A process according to claim 1, wherein a1), a2), b2) and c) are conducted at a reaction temperature of 20 to 80° C.

4. A process according to claim 1, wherein the quantity of the ammonia in a1) or b2) is 0.1 to 20 parts by weight in relation to 100 parts by weight of the shaved weight of the tanned leather.

5. A process according to claim 1, wherein the ammonia in a1) and b2) is generated in situ by hydrolysis of ammonium salts with bases.

6. A process according to claim 5, wherein the ammonium salts are ammonium salts of polymeric water-soluble carboxylic acids or inorganic ammonium salts.

7. A process according to claim 1, wherein the quantity of the polyfunctional organic compound in a2), b1) and b2) is 0.1 to 20 parts by weight in relation to 100 parts by weight of the shaved weight of the tanned leather.

8. A process according to claim 1, wherein the polyfunctional organic compound contains one aldehyde group and a further 1 to 4 functional groups for covalent bonding of the dye, where the functional groups are bonded to the aldehyde group either directly or via an organic bridging group.

9. A process according to claim 8, wherein the bridging group contains 1 to 30 C atoms, where carbon bonds may be broken by O, S, NR, C(O)O or C(O)NR, wherein R is hydrogen or $C_1$–$C_4$alkyl.

10. A process according to claim 8, wherein the functional groups for the formation of covalent bonds are selected from the group consisting of —CHO, —OH, —SH, —NHR, isocyanate, masked isocyanate, carboxyl, carboxylate, carbamide, sulfoxyl, sulfoxylate, and sulfonamide, wherein R is hydrogen or $C_1$–$C_4$alkyl.

11. A process according to claim 10, wherein the functional group is —CHO.

12. A process according to claim 1, wherein the polyfunctional organic compound is a compound of formula I;

$$OHC—B—(F)_x \quad (I),$$

wherein

B is a direct bond or a bivalent or trivalent bridging group with 1 to 12 C atoms, x is the number 1 or 2, and F is a functional group which is capable of reacting with the functional group of a dye.

13. A process according to claim 12, wherein B is a bivalent bridging group and x is the number 1.

14. A process according to claim 13, wherein B is linear or branched $C_1$–$C_{12}$alkylene, $C_3$–$C_{12}$cycloalkylene, $C_1$–$C_4$alkylene-$C_5$–$C_8$cycloalkylene, $C_1$–$C_4$alkylene-$C_5$–$C_8$cycloalkylene-$C_1$–$C_4$alkylene, $C_6$–$C_{12}$arylene, $C_7$–$C_{16}$aralkylene, or $C_1$–$C_4$-alkylene-$C_6$–$C_{12}$arylene-$C_1$–$C_4$alkylene.

15. A process according to claim 12, wherein the functional group F is selected from the group consisting of —CHO, —OH, —SH, —NHR, —$CO_2H$, —$CO_2R_1$, —C(O)—$NR_2R_3$, —NCO, —$SO_3H$, —$SO_2OR_1$, and —$SO_2$—$NR_2R_3$, wherein R is hydrogen or $C_1$–$C_4$alkyl, $R_1$ is $C_1$–$C_4$alkyl, and $R_2$ and $R_3$ are independently of one another hydrogen or $C_1$–$C_4$alkyl.

16. A process according to claim 12, wherein B is a direct bond or $C_1$–$C_8$alkylene and F is —CHO.

17. A process according to claim 1, wherein the polyfunctional organic compound is selected from the group consisting of glyoxal, malondialdehyde, glutardialdehyde, succinaldehyde, dialdehyde starch and mixtures thereof.

18. A process according to claim 1, wherein the quantity of the dye in c) is 0.1 to 20 parts by weight in relation to 100 parts by weight of the shaved weight of the tanned leather.

19. A process according to claim 1, wherein (c) further comprises addition of inorganic bases to maintain the pH value.

20. A process according to claim 19, wherein the inorganic base is added either separately or mixed with the dye.

21. A process according to claim 1, wherein the dyes with functional groups in c) are selected from the group consisting of azo dyes, metal complex azo dyes, anthraquinone dyes, diarylmethane and triarylmethane dyes, sulfur dyes, phthalocyanine dyes, azine dyes, oxazine dyes and thiazine dyes.

22. A process according to claim 21, wherein the functional group is selected from the group consisting of —CHO, —OH, —SH, —NHR, $—CO_2H$, $—CO_2R_1$, $—C(O)—NR_2R_3$, —NCO, $—SO_3H$, $—SO_2OR_1$, and $—SO_2—NR_2R_3$, wherein R is hydrogen or $C_1$–$C_4$alkyl, $R_1$ is $C_1$–$C_4$alkyl, and $R_2$ and $R_3$ are independently of one another hydrogen or $C_1$–$C_4$alkyl.

23. A process according to claim 1, wherein the dye is a dye of formula II, $$\text{Dye-}(X—Z)_y \qquad \text{(II)},$$

wherein dye is the backbone chain of a water-soluble, organic or metal organic dye, X is a direct bond or a bivalent bridging group, Z is a functional group which is capable of reacting with the functional groups of the polyfunctional organic compound, forming a covalent bond, and y is a number from 1 to 10.

24. A process according to claim 23, wherein the bridging group is $C_1$–$C_{12}$alkylene, which may be broken by O, S or NR, where R is H or $C_1$–$C_4$alkyl.

25. A process according to claim 23, wherein Z is —OH, —SH or $—NH_2$.

26. A process according to claim 25, wherein Z is $—NH_2$.

27. A process according to claim 23, wherein y is a number from 1 to 6.

28. A process according to claim 1, wherein a part of the dye is added in a1) or b1) and the remainder of the dye is added in c).

29. A process according to claim 1, wherein a sulfur dye is concomitantly added in c).

30. A tanned and dyed leather wherein the dye is permanently and covalently bonded to the leather via a bridging group, and the bridging group is essentially bonded to the leather via —N═CH— groups, with the proviso that the leather is not anionic tanned or retanned.

31. A leather according to claim 30, wherein a large number of groups of formula XXII are covalently bonded in the region of the surface of the leather, $$—N═CH—B—(Y—X\text{-dye})_r \qquad \text{(XXII)},$$

wherein

B is a direct bond or a bivalent or trivalent bridging group with 1 to 12 C atoms, X is a direct bond or a bivalent bridging group, r is the number 1 or 2, and Y is a group formed from a functional group of a polyfunctional organic compound and a functional group of a dye.

32. A leather according to claim 31, wherein r in formula XXII is the number 1.

33. A leather according to claim 31, wherein X is a direct bond or a bridging group which is $C_1$–$C_{12}$alkylene, which may be broken by O, S or NR, where R is H or $C_1$–$C_4$alkyl.

34. A leather according to claim 31, wherein B is a bivalent bridging group and r is the number 1.

35. A leather according to claim 34, wherein B is linear or branched $C_1$–$C_{12}$alkylene, $C_3$–$C_{12}$cycloalkylene, $C_1$–$C_4$alkylene-$C_5$–$C_8$cycloalkylene, $C_1$–$C_4$alkylene-$C_5$–$C_8$cycloalkylene-$C_1$–$C_4$alkylene, $C_6$–$C_{12}$arylene, $C_7$–$C_{16}$aralkylene, or $C_1$–$C_4$-alkylene-$C_6$–$C_{12}$arylene-$C_1$–$C_4$alkylene.

36. A leather according to claim 31, wherein the group Y is selected from the group of consisting of imine, ester, amide, urea and urethane groups.

37. A leather according to claim 36, wherein Y is selected from the group consisting of —HC═N—, —N═CH—, —C(O)—O—, —O—C(O)—, —C(O)—S—, —S—C(O)—, —C(O)—NR—, —NR—C(O)—, —NH—C(O)—NR—, —NR—C(O)—NH—, —O—C(O)—NR—, —NR—C(O)—O—, —S—C(O)—NR—, and —NR—C(O)—S—.

38. A leather according claim 36, wherein the group Y is —CH═NH—.

39. A leather according to claim 31, wherein B in formula XXII is a bivalent bridging group with 1 to 8 C atoms, X is a direct bond, r is the number 1, and Y is —HC═N—.

40. A leather according to claim 31, wherein the dyes of formula XXII are selected from the group consisting of azo dyes, metal complex azo dyes, anthraquinone dyes, diarylmethane and triarylmethane dyes, sulfur dyes, phthalocyanine dyes, azine dyes, oxazine dyes and thiazine dyes.

41. A tanned and dyed leather, obtainable by the process according to claim 1.

42. A tanned and dyed leather according to claim 30, wherein the dye is bonded to the leather via the bridging group in the region of the surface of the leather.

43. A process according to claim 1, wherein up to 60% of the dye is allowed to act on the leather after b1) and before b2).

* * * * *